US006832891B2

(12) United States Patent
Aschenbruck et al.

(10) Patent No.: US 6,832,891 B2
(45) Date of Patent: Dec. 21, 2004

(54) DEVICE FOR SEALING TURBOMACHINES

(75) Inventors: Emil Aschenbruck, Duisburg (DE); Hildegard Ebbing, Oberhausen (DE); Andreas Kleinefeldt, Ratingen (DE); Klaus Dieter Mohr, Wuppertal (DE)

(73) Assignee: Man Turbomaschinen AG, Oberhausen (DE)

( * ) Notice: Subject to any disclaimer, the term of this patent is extended or adjusted under 35 U.S.C. 154(b) by 10 days.

(21) Appl. No.: 10/268,422

(22) Filed: Oct. 10, 2002

(65) Prior Publication Data

US 2003/0082050 A1 May 1, 2003

(30) Foreign Application Priority Data

Oct. 29, 2001 (DE) ..... 101 52 752
Apr. 2, 2002 (DE) ..... 102 14 624

(51) Int. Cl.[7] ..... F01D 11/00
(52) U.S. Cl. ..... 415/173.7; 415/115
(58) Field of Search ..... 415/173.7, 174.4, 415/174.5, 115, 116, 47; 416/96 R, 96 A, 97 R

(56) References Cited

U.S. PATENT DOCUMENTS 3,945,758 A 3/1976 Lee
5,157,914 A 10/1992 Schwarz et al.
5,358,374 A * 10/1994 Correia et al. ..... 415/47
5,609,466 A * 3/1997 North et al. ..... 415/115
5,749,701 A 5/1998 Clarke et al.
6,065,928 A * 5/2000 Rieck, Jr. et al. ..... 415/115
6,077,034 A * 6/2000 Tomita et al. ..... 415/110
6,109,867 A 8/2000 Jacques Portefaix
6,171,052 B1 1/2001 Aschenbruck et al.
6,217,279 B1 * 4/2001 Ai et al. ..... 415/110
6,398,485 B1 * 6/2002 Frosini et al. ..... 415/115
6,398,488 B1 * 6/2002 Solda et al. ..... 415/115

FOREIGN PATENT DOCUMENTS

DE 25 07 182 9/1975
DE 198 21 365 11/1999
EP 0 919 698 6/1999

* cited by examiner

*Primary Examiner*—Edward K. Look
*Assistant Examiner*—J. M. McAleenan
(74) *Attorney, Agent, or Firm*—McGlew and Tuttles, P.C.

(57) ABSTRACT

A device for sealing between the guide vanes (1) and the rotor (17) of turbomachines, especially gas turbines has inner rings (3) suspended on the vane footing (14) of the guide vanes (1) in a thermally elastic manner with soldered honeycomb seal (4) and labyrinth tips (5) arranged on the rotor (17). First flow channels, which are connected to the cavities (21) of the cooled guide vanes (1), through which said cavities cooling air flows, are led through the vane footings (14). The first flow channels are connected to at least one of second flow channels led through the inner ring (3) to the vicinity of the honeycomb seal (4). The second flow channels open into at least one of third flow channels that are open at the rear edge of the inner ring (3) or are led to an annular groove (10) open toward the honeycomb seal (4) on the underside of the inner ring (3).

20 Claims, 6 Drawing Sheets

DEVICE FOR SEALING TURBOMACHINES

FIELD OF THE INVENTION

The present invention pertains to a device for sealing between the guide vanes and the rotor of turbomachines, especially gas turbines.

BACKGROUND OF THE INVENTION

In a seal in turbomachines, which has been known from practice, the inner ring suspended on the guide vanes with the soldered honeycomb seal is uncooled. To reliably avoid a metallic contact between the rotor and the stator of the turbomachine, the distance between the honeycomb seal and the tips of the labyrinth must be dimensioned to the largest possible amount of the thermal expansion. The relatively great distance leads to a large leakage flow.

A cooled honeycomb seal, which is arranged at the outer limitation of the flow channel within a gas turbine, has been known from DE-A 19 821 365. Part of the cooling air, which is available to the guide vane located upstream at the outer shrouding, is fed for cooling to the honeycomb seal through holes in the ring carrying the honeycomb seal.

Gas turbines with internally cooled guide vanes have been known from U.S. Pat. Nos. 5,749,701 and 5,157,914. Sealing segments, which contain a honeycomb seal, are rigidly connected to the guide vanes. The sealing segments are fixed radially and are not suspended in a thermally elastic manner. Cooling air is fed to the sealing segments from the cooled guide vanes. This cooling air is used above all to block the sealing gap between the sealing segments and labyrinth tips and less to cool the honeycomb seal. The width of the sealing gap is not affected by the cooling air because of the non-thermally elastic suspension of the sealing segments.

SUMMARY OF THE INVENTION

The basic object of the present invention is to design the seal of this type such that the distance between the honeycomb seal and the labyrinth tips can be reduced to reduce the leakage flows while increasing the efficiency of the turbomachine at the same time.

According to the present invention a device for sealing between the guide vanes and the rotor of turbomachines, especially gas turbines with an inner ring suspended on the vane footing of the guide vanes in a thermally elastic manner with a soldered honeycomb seal and labyrinth tips arranged on the rotor. Each guide vane has a cavity through which cooling air flows. First flow channels are connected to the cavities of the guide vanes. The first flow channels are led through the vane footings of the guide vanes and the flow channels are connected to at least one of second flow channels. The second flow channels are led to the vicinity of the honeycomb seal and to which at least one connection leading to the outside of the inner ring is connected.

The second flow channels may open into at least one of axial third flow channel, which are open at the rear edge of the inner ring and form connections of the second flow channels, which connections lead to the outside of the inner ring. The second flow channels may be led to an annular groove open toward the honeycomb seal on the underside of the inner ring, which forms the connection of the second flow channels, which connection leads to the outside of the inner ring.

Fourth flow channels, which may be led to another annular groove open toward the honeycomb seal on the underside of the inner ring, may be branched off from the second flow channels.

The first flow channels may be designed as a hole each passing through the vane footing of the guide vanes. The first flow channels may be designed as an inner hole led through a hollow centering pin and as a hole connecting the inner hole to the cavity of the guide vane.

The second flow channels may be designed as holes led radially through the inner ring or as holes led three-dimensionally diagonally. The third flow channels may be designed as holes led axially through the inner ring. The fourth flow channels may be designed as holes led obliquely through the inner ring.

The inner ring may comprise two parts, which are provided with grooves and projections on sides facing each other. The grooves and projections may engage one another such that a serpentine-like, fifth flow channel is formed, to which at least one connection leading to the outside of the inner ring is connected.

The honeycomb seal may be protected by the cooling air discharged from the honeycomb seal and/or the inner ring against the break-in of hot gas.

The amount of the cooling air fed to the inner ring can be regulated and depending on the amount of the cooling air, the leakage flows flowing through the gap between the honeycomb seal and the labyrinth tips can flow only forward or both forward and backward. The amount of the cooling air fed to the inner ring can be regulated by the pressure of the cooling air in the guide vane, the diameter of the holes or by selecting the shape of the inlet and outlet of the holes.

The annular gap between the honeycomb seal and the labyrinth tips, which gap acts as a sealing gap, is determined decisively by the temperature of the inner ring suspended in a thermally elastic manner. The cooling air led through the inner ring cools this ring and thus lowers its component temperature. As a result, a smaller internal diameter of the honeycomb seal and consequently also a smaller annular gap become established because of the lower thermal expansion. Due to the inner ring being supplied with cooling air, the width of the sealing gap can thus be affected. The sealing gap can be dimensioned to be narrower from the very beginning.

Furthermore, the break-in of hot gas from the flow channel of the guide vanes into the honeycomb seal is avoided and the leakage flow will also decrease correspondingly as a result. This is associated with an increase in the efficiency of the turbomachine. The life-limiting material temperature is reduced, the temperature resistance and the corrosion resistance of the components affected are improved, and the service life of the part of the turbomachine exposed to hot gas is prolonged due to the cooling of the inner ring and of the honeycomb seal. A metallic contact between the rotor and the stator in transient states of the turbomachine can be avoided by regulating the cooling. Because of the advantageous properties indicated, the present invention is especially suitable for the hub sealing between the rotor and the stator of gas turbines.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 7:
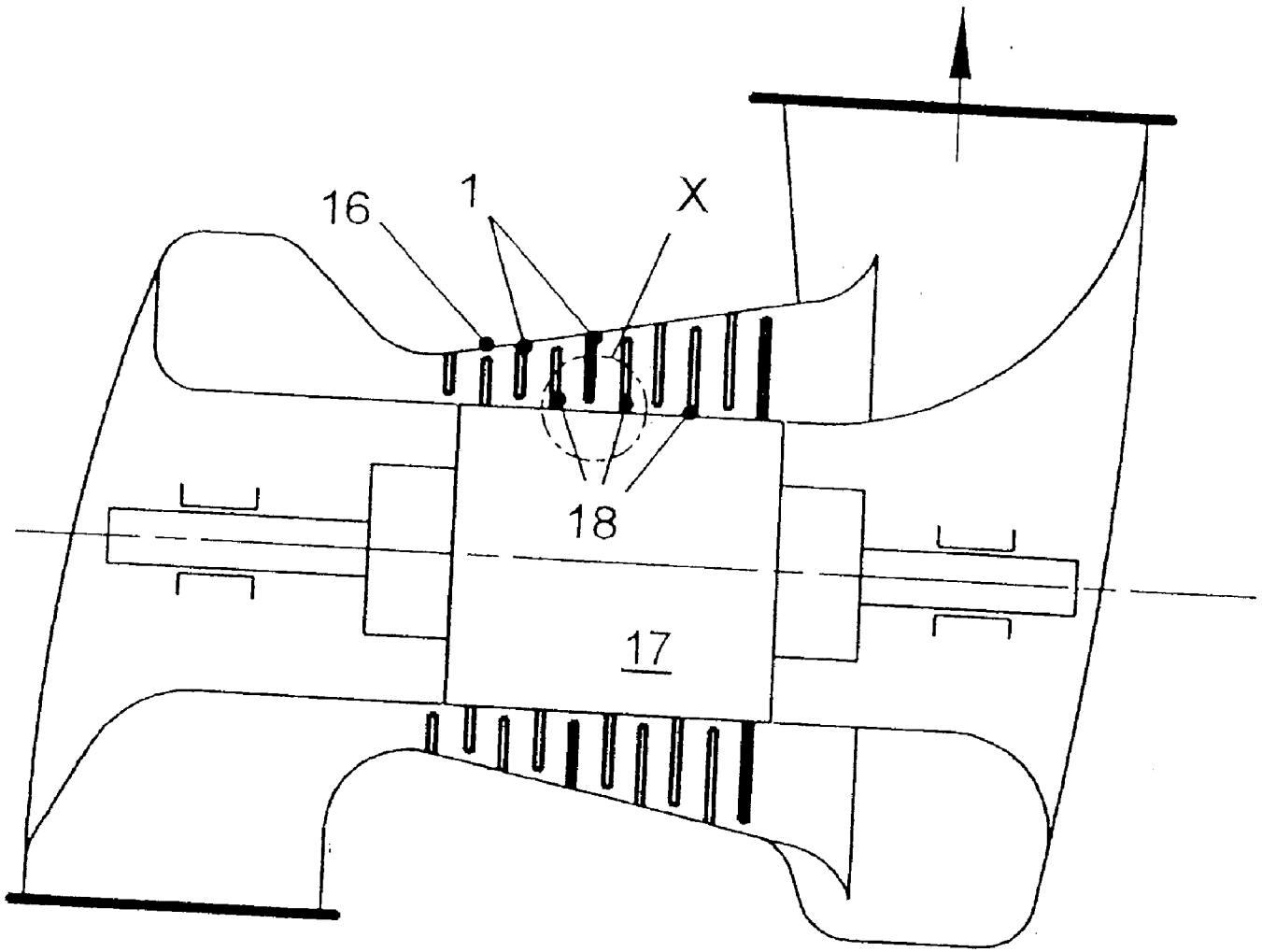
FIG. 7 is a schematic view showing the longitudinal section through a gas turbine.

Referring to the drawings in particular, the design of turbomachines as a gas turbine comprises, according to FIG. 7, a housing 16, in which a rotor 17 is mounted rotatably. The rotor 17 carries a plurality of rows of guide vanes 18, between which stationary guide vanes 1 fastened to the housing 16 are arranged.

Part of the rotor 17 with two guide vanes 18 and with the lower part of a guide vane 1 are shown in FIGS. 1 through 5 and 9 through 11.

The guide vane 1 is provided with a guide vane footing 14 at its end facing the rotor 17. An inner ring 3 is suspended at the guide vane footing 14 in a thermally elastic manner. The guide vane footing 14 is provided for this purpose with an attachment 19, which engages an adapted recess 20 in the inner ring 3, a gap 13 absorbing the thermal expansion being left between the front surface of the attachment 19 of the guide vane footing 14 and the bottom of the recess 20 of the inner ring 3. Centering pins 2, which are inserted into the attachment 19 of the guide vane footing 14 and into the bottom of the recess 20 of the inner ring 3, ensure the centering of the inner ring 3 at the guide vane footing 14.

A honeycomb seal 4 is soldered on the surface of the inner ring 3 facing the rotor 17. The honeycomb seal 4 contains an open honeycomb structure, which is formed by webs. The webs are connected to the inner ring 3 and limit the inwardly open honeycombs. Labyrinth tips 5 of a one-part labyrinth ring acting as a seal, which ring is arranged on the rotor 17, are located opposite the honeycomb seal 4. There is a sealing gap of a radial height, which is to be kept small, between the labyrinth tips 5 rotating with the rotor 17 and the stationary honeycomb seal 4.

The guide vanes 1 are cooled and have a cavity 21, through which cooling air flows. The cooling air leaves at the rear edge 6 of the guide vane.

To keep the sealing gap between the stationary honeycomb seal 4 and the rotating labyrinth tips 5 small and to reduce the leakage flows passing through the sealing gap, the inner ring 3 and the honeycomb seal 4 are cooled as well. The cooling is brought about by a small partial flow of the cooling air used to cool the guide vane 1, whose main flow escapes at the rear edge 6 of the guide vane.

Figure 1:
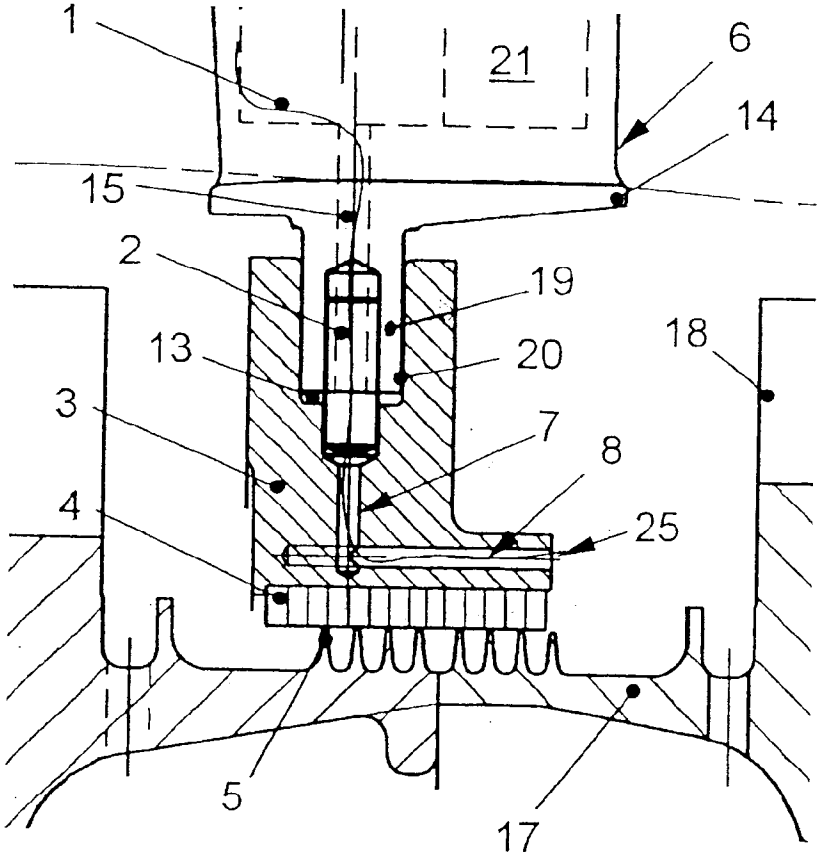
FIG. 1 is a detail X of a gas turbine according to FIG. 7 according to an embodiment of the invention.
Figure 3:
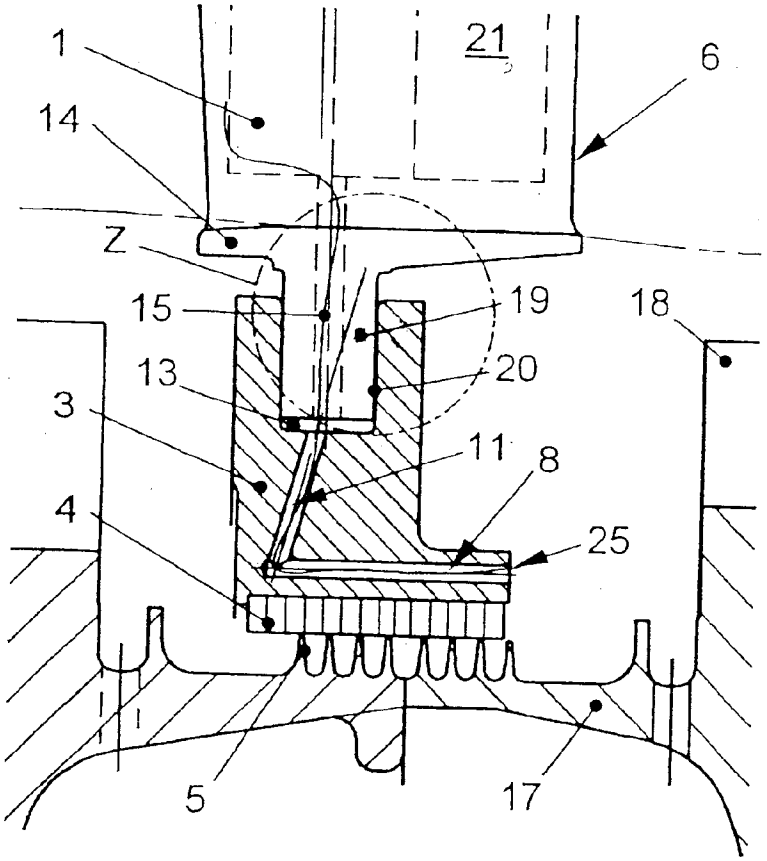
FIG. 3 is a detail X of a gas turbine according to FIG. 7 according to another embodiment of the invention.
Figure 6:
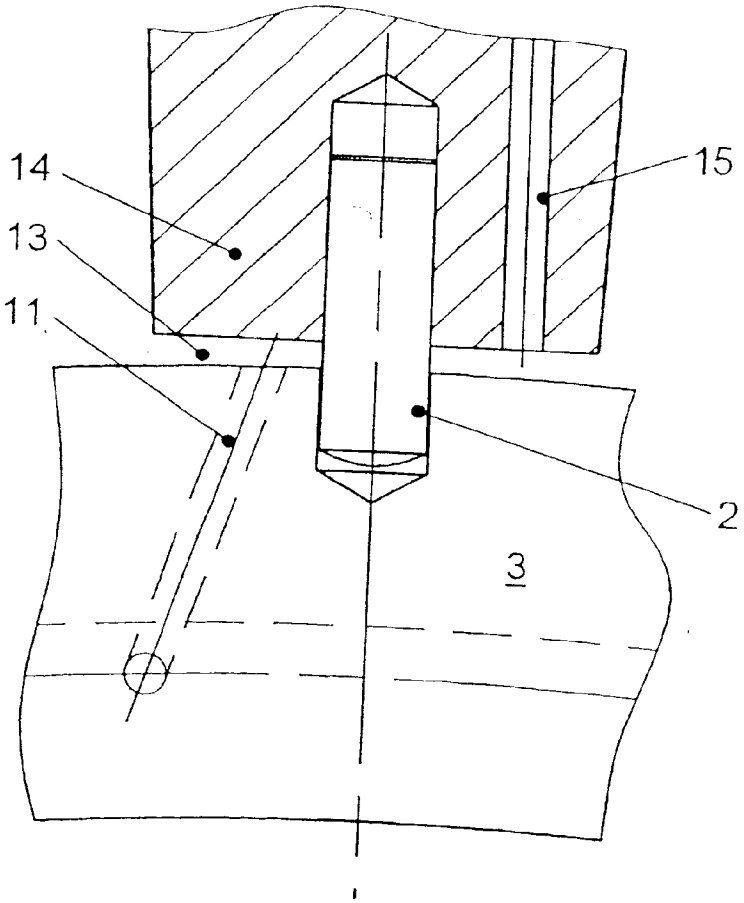
FIG. 6 is a detail Z according to FIG. 3.

The cooling air is taken from the guide vane 1. A first flow channel, which is designed as a hole 15 and opens into the gap 13 between the guide vane footing 14 and the inner ring 3, is led through the guide vane footing 14 for this purpose. Second flow channels 13, which are led through the inner ring 3 as radial holes 7 or as three-dimensionally diagonal holes 11, originate from the gap 13. The holes 7, 11 open into third flow channels, which are led as axial holes 8 through the inner ring 3. The axial holes 8 are open at the rear edge of the inner ring 3 and form the outlet 25. The partial cooling air flow, which is taken from the guide vane 1 through the hole 15, is distributed in the gap 13 between the guide vane footing 14 and the inner ring 3, enters the radial and three-dimensionally diagonal holes 7, 11, and escapes via the axial holes 8 through the outlets 25. The cooling air taken from the guide vane 1 lowers the temperature of the inner ring 3 and the honeycomb seal 4 while this passes over the holes 7, 11, 8 (FIGS. 1, 3, 6).

Figure 8:
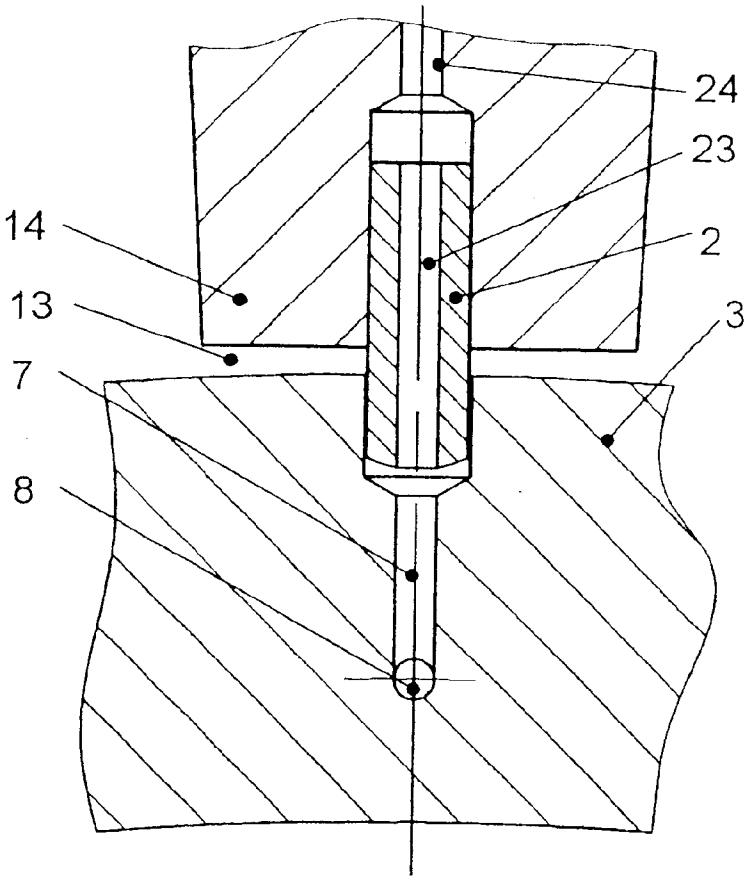
FIG. 8 is a detail Z according to FIG. 3 of another embodiment of the invention.

According to FIG. 8, the first flow channel may also be designed as an inner hole 23 of a hollow centering pin 2, the inner hole 23 being in connection with the cavity 21 of the guide vane 1 via a hole 24 extending radially through the guide vane footing 14. At least one of the radial holes 7, which are likewise designed as a second flow channel, is connected to the inner hole 23 of the hollow centering pin 2. One of the radial holes 7 each opens into one of the axial holes 8 each.

Figure 4:
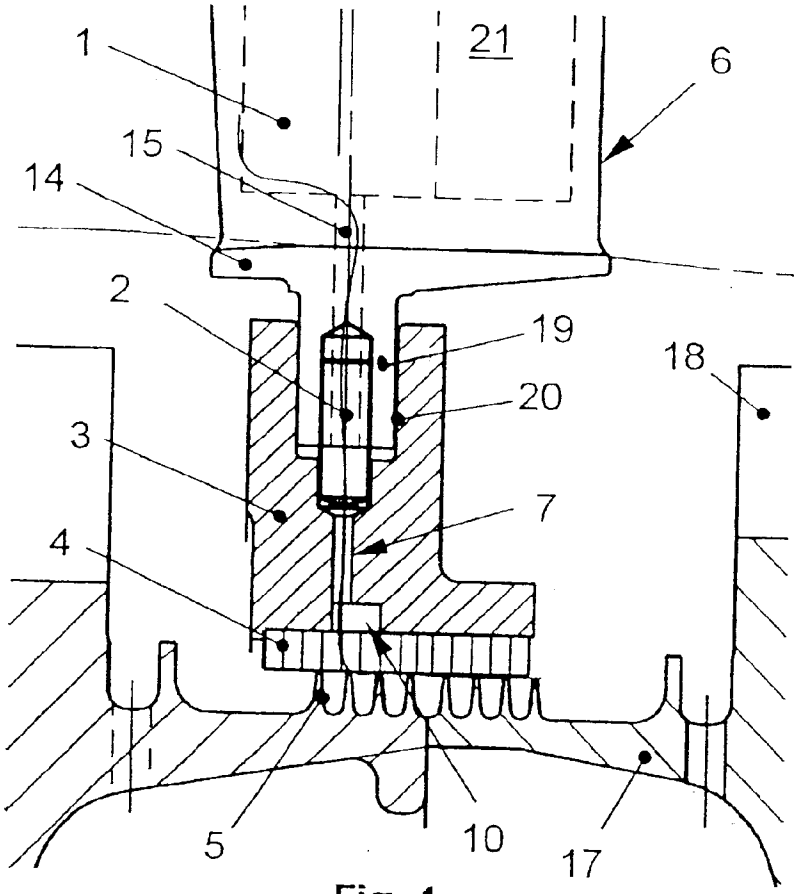
FIG. 4 is a detail X of a gas turbine according to FIG. 7 according to another embodiment of the invention.

According to FIG. 4, the radial holes 7 end in an open annular groove 10, which is cut into the surface of the inner ring 3 facing the rotor 17. The cooling air taken from the guide vane 1 is discharged through the honeycomb seal 4 and cools same directly in the process.

Figure 2:
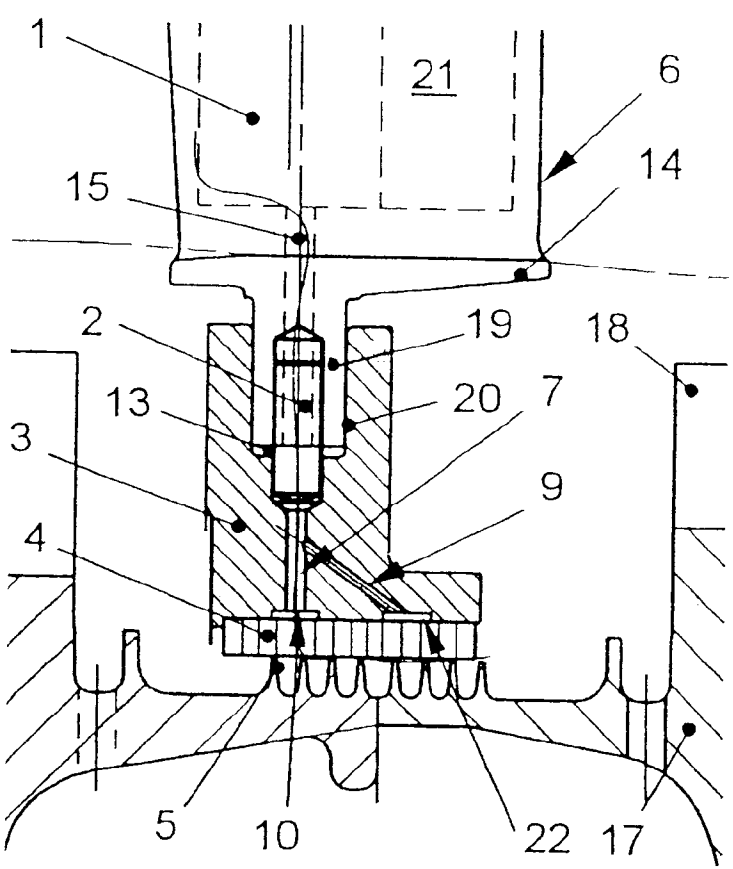
FIG. 2 is a detail X of a gas turbine according to FIG. 7 according to another embodiment of the invention.

As is shown in FIG. 2, fourth flow channels, which are led as oblique holes 9 through the inner ring 3 and end in another annular groove 22, may branch off from at least one of the radial holes 7, which act as second flow channels. The honeycomb seal 4 is thus cooled over a large area.

Figure 5:
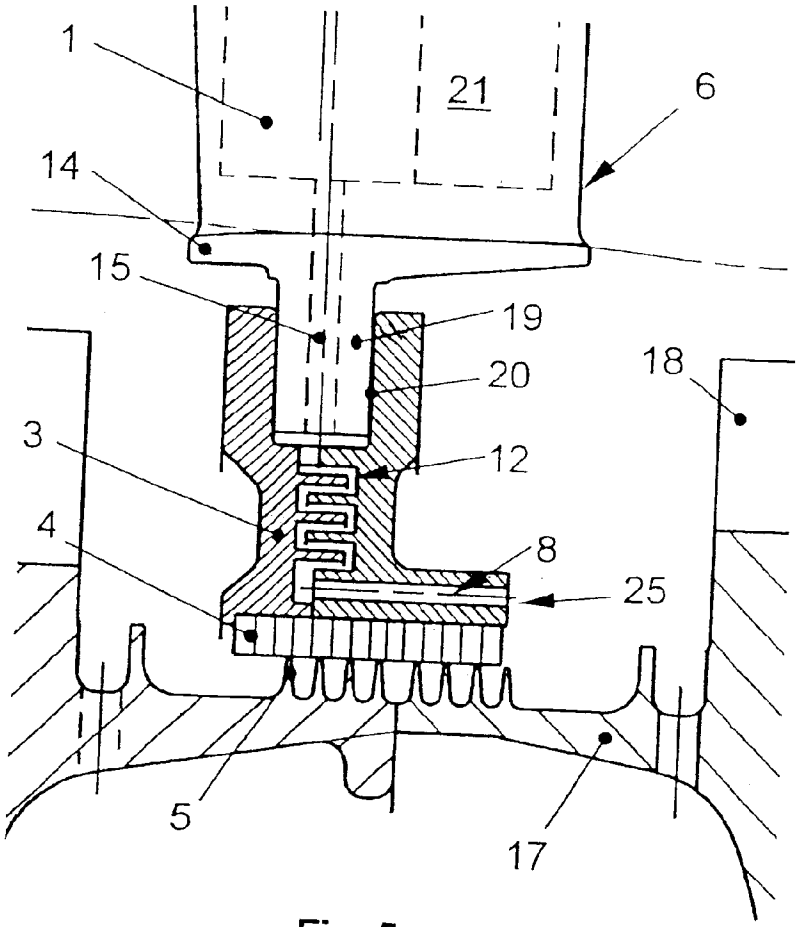
FIG. 5 is a detail X of a gas turbine according to FIG. 7 according to another embodiment of the invention.

According to FIG. 5, the inner ring 3 comprises two parts, which are provided with grooves and projections on the sides facing one another. The two parts of the inner ring 3 are fitted together such that the grooves and projections engage one another and form serpentines 12 as a result, which represent a fifth flow channel led through the inner ring 3. The serpentines 12 are in connection with the axial holes 8. Due to this serpentine-like guiding of the cooling air, the residence time of the cooling air in the inner ring 3 is longer than in the other embodiments described. In addition, the surface available for heat transfer (cooling) is increased by the serpentines 12 and so is the effectiveness of the cooling.

Figure 9:
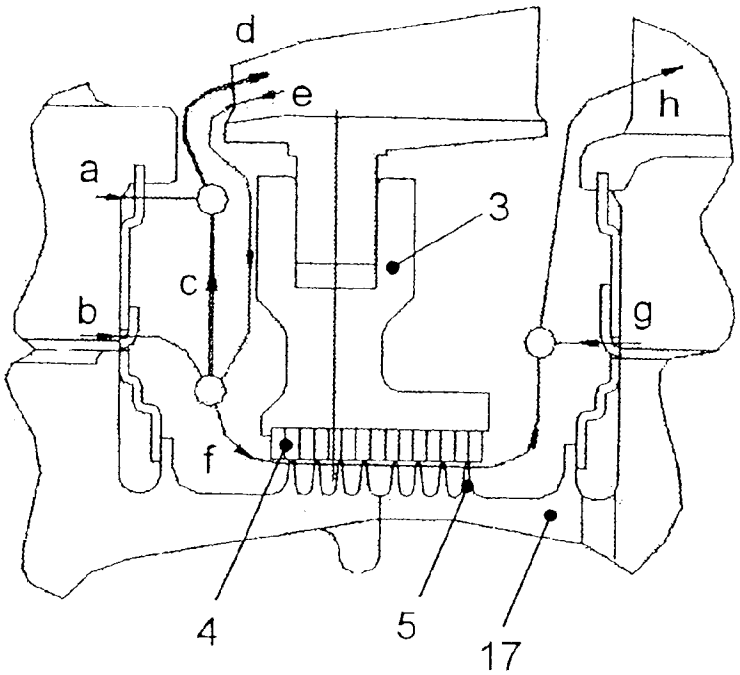
FIG. 9 is a schematic view showing an embodiment of the cooling air flow distributions.
Figure 11:
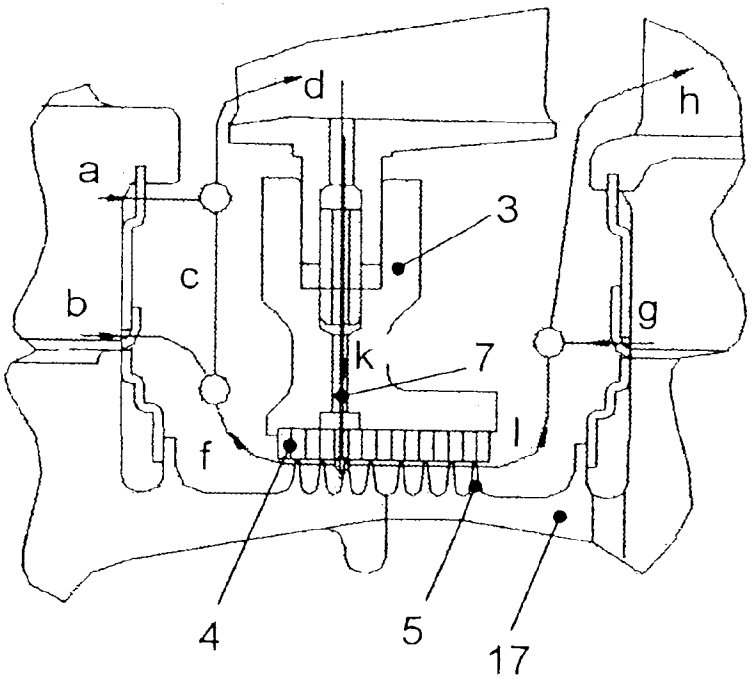
FIG. 11 is a schematic view showing another embodiment of the cooling air flow distributions.
Figure 10:
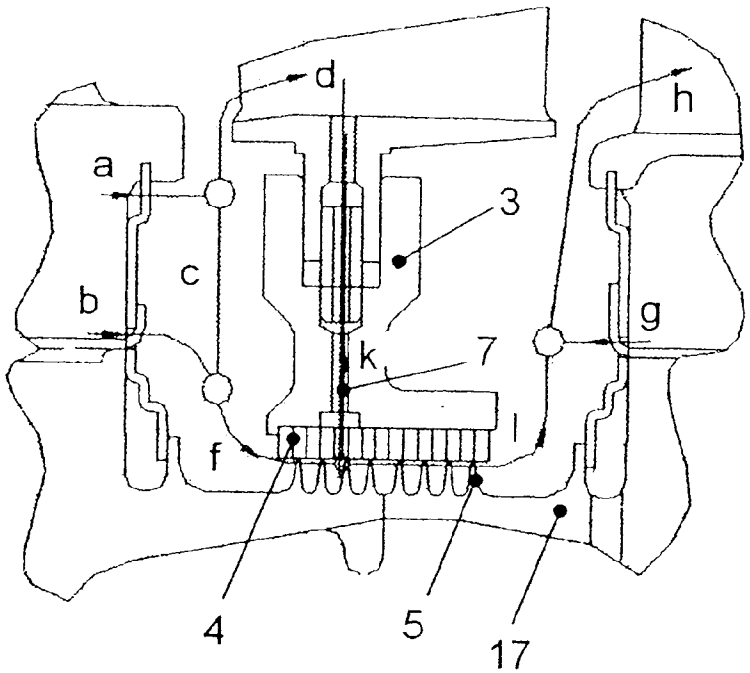
FIG. 10 is a schematic view showing another embodiment of the cooling air flow distributions.

FIGS. 9 through 11 show the cooling air flows a through 1 in the area of the inner ring 3 for different variants; these cooling air flows are composed as follows:

a) Cooling air flowing from the guide vanes 18 of the moving blade ring, which is arranged in front of the guide vane 1 shown, b) as a), but on a radius closer to the rotor axis, c) indifferent distribution flow between the rotor 17 and the inner ring 3, d) cooling air that escapes into the flow channel in front of the guide vanes 1, e) hot gas, f) leakage flow (flowing forward in FIG. 10 and backward in FIG. 11), g) cooling air that flows from the guide vanes 18 of the moving blade ring that is arranged behind the guide vane 1 shown, h) as d), but behind the guide vanes 1, k) cooling air that is fed from the cavity 21 of the guide vane 1 to the inner ring 3, l) leakage flow.

FIG. 9 shows the cooling air flows a through h for the uncooled variant of the inner ring 3 according to the state of the art. As is apparent from FIG. 9, a hot gas flow e is drawn from the flow channel of the guide vane 1 into the annular gap between the honeycomb seal 4 and the labyrinth tips 5 and it leads to an increase in the leakage flow f there. This leads, furthermore, to an increase in the temperature of the inner ring 3 with a further thermal elastic expansion of the inner ring 3.

FIGS. 10 and 11 show the cooling air flows a through l for the cooled variant of the inner ring 3, where the cooling air flow k is small in FIG. 10 and large in FIG. 11. The amount of the cooling air flow k can be changed by a higher pressure of the cooling air in the guide vane 1, a larger diameter of the hole 7 or by changing the flow resistance by selecting the shape of the inlet and outlet (rounded, sharp-edged) of the hole 7.

FIG. 10 shows a variant with cooling of the inner ring 3, where the cooling air flow k is a cooling air flow of a small volume. It can be seen that the break-in of hot gas e is avoided and a substantially smaller leakage flow f flows through the annular gap between the honeycomb seal 4 and the labyrinth tips 5. The leakage flow f flows through the annular gap between the honeycomb seal 4 and the labyrinth tips 5 in one direction.

If the cooling air flow k is increased, as is shown in FIG. 11, it is split into the two leakage flows f and l, which leave the annular gap between the honeycomb seal 4 and the labyrinth tips 5 on both sides of the inner ring 3. The break-in of hot gas e and the pumping action are avoided in this case as well. The inner ring 3 assumes a lower temperature, and thermal elastic expansion is avoided in both FIG. 10 and FIG. 11.

While specific embodiments of the invention have been shown and described in detail to illustrate the application of the principles of the invention, it will be understood that the invention may be embodied otherwise without departing from such principles.

What is claimed is:

1. A device for sealing between guide vanes and a rotor of a gas turbine turbomachine, the device comprising:

a cavity within each guide vane, said cavity being blown through by cooling air, each guide vane having a footing;

an inner ring with a recess on an outer rim of said inner ring, wherein said inner ring is suspended on said vane footing in a thermally elastic manner;

an attachment connected to said footing of each said guide vanes; a centering pin coupling, said attachment to said recess;

a honeycomb seal soldiered to said footing;

labyrinth tips arranged on the rotor and being located opposite said honeycomb seal;

a first flow channel connected to said cavity of said guide vane, said first flow channel comprising a hole passing through said vane footing of said guide vane; and a second flow channel connected to said first flow channel, said second flow channel comprising a second hole passing through said inner ring into the vicinity of said honeycomb seal and having at least one connection leading to the outside of the inner ring.

2. A device in accordance with claim 1, further comprising an axial third flow channel including an opening affixed at rear edge of said inner ring wherein said second flow channel joins said axial third flow channel.

3. A device in accordance with claim 1, wherein said second flow channel is led to an annular groove open toward said honeycomb seal on an underside of said inner ring, said annular groove forming said at least one connection of said second flow channel leading to the outside of said inner ring.

4. A device in accordance with claim 3, further comprising: a further flow channel connected to another annular groove open toward the honeycomb seal on the underside of said inner ring, said further flow channel being branched off from said second flow channel.

5. A device in accordance with claim 1, wherein said first flow channel comprises an inner hole led through a hollow centering pin and a hole connecting said inner hole to said cavity of said guide vane.

6. A device in accordance with claim 1, wherein said second flow channel comprises a hole led radially through said inner ring or a hole led three-dimensionally diagonally, and a third flow channel is provided as a hole led axially through said inner ring, and a fourth flow channel is provided as a hole led obliquely through said inner ring.

7. A device in accordance with claim 1, wherein said inner ring comprises two parts provided with grooves and projections on sides facing each other and said grooves and projections engage one another to form a serpentine-like further flow channel to which at least one connection leading to the outside of said inner ring is connected.

8. A device in accordance with claim 1, wherein said honeycomb seal is protected by the cooling air discharged from said honeycomb seal and/or said inner ring against the break-in of hot gas.

9. A device in accordance with claim 1, wherein the amount of the cooling air fed to the inner ring is regulated and that depending on the amount of the cooling air, the leakage flows flowing through a gap between said honeycomb seal and said labyrinth tips can flow only forward or both forward and backward.

10. A device in accordance with claim 1, wherein an amount of cooling air fed to said inner ring is regulated by a pressure of the cooling air in said guide vane, a diameter of said holes or a selected shape of an inlet and an outlet of said holes.

11. A device for sealing between guide vanes and a rotor of a gas turbine turbomachine, the device comprising:

a set of guide vanes, each said guide vane further comprising:

a cavity within said guide vane;

a footing at inner rim of said guide vane;

an attachment coupled to said footing;

a centering pin with a first distal end and a second distal end, wherein said first distal end is inserted into said attachment;

a first flow channel connected to said cavity and formed through said footing; and a stream of cooling air flowing from said cavity through said first flow channel;

an inner ring having an outer rim with a recess and an inner rim, said inner ring suspended on said footing in a thermally elastic manner, said second distal end of said centering pin being inserted into a bottom of said recess to align said inner ring with said footing;

a honeycomb seal attached to said inner rim;

a set of labyrinth tips arranged on the rotor and being located opposite said honeycomb seal; and a second flow channel joined to said first flow channel, said second flow channel formed through said inner ring into the vicinity of said honeycomb seal and having at least one opening affixed to outside of said inner ring.

12. A device in accordance with claim 11, further comprising an axial third flow channel including an opening affixed at rear edge of said inner ring wherein said second flow channel joins said axial third flow channel.

13. A device in accordance with claim 12, wherein said second flow channel includes an annular groove opening affixed to said honeycomb seal on the underside of said inner ring, said annular groove opening leading to outside of said inner ring.

14. A device in accordance with claim 12, further including a tertiary flow channel having a first end joined to said second flow channel and having other end joined to second annular groove opening on the underside of said inner ring toward the honeycomb seal.

15. A device in accordance with claim 12, wherein said first flow channel comprises an inner hole led through a hollow centering pin and a hole connecting said inner hole to said cavity of said guide vane.

16. A device in accordance with claim 12, wherein said second flow channel comprises a hole led radially through said inner ring or a hole led three-dimensionally diagonally, and a third flow channel is provided as a hole led axially through said inner ring, and a fourth flow channel is provided as a hole led obliquely through said inner ring.

17. A device in accordance with claim 12, wherein said inner ring comprises two parts provided with grooves and projections on sides facing each other and said grooves and projections engage one another to form a serpentine-like further flow channel to which at least one connection leading to the outside of said inner ring is connected.

18. A device in accordance with claim 12, wherein said honeycomb seal is protected by the cooling air discharged from said honeycomb seal and/or said inner ring against the break-in of hot gas.

19. A device in accordance with claim 11, wherein the amount of the cooling air fed to the inner ring is regulated and that depending on the amount of the cooling air, the leakage flows flowing through a gap between said honeycomb seal and said labyrinth tips can flow only forward or both forward and backward.

20. A device in accordance with claim 12, wherein an amount of cooling air fed to said inner ring is regulated by a pressure at the cooling air in said guide vane, a diameter of said holes or a selected shape of an inlet and an outlet of said holes.

* * * * *